US008943930B2

(12) United States Patent
Liu

(10) Patent No.: US 8,943,930 B2
(45) Date of Patent: Feb. 3, 2015

(54) WRENCH DEVICE

(71) Applicant: Chao-Chih Liu, Taichung (TW)

(72) Inventor: Chao-Chih Liu, Taichung (TW)

( * ) Notice: Subject to any disclaimer, the term of this patent is extended or adjusted under 35 U.S.C. 154(b) by 218 days.

(21) Appl. No.: 13/772,335

(22) Filed: Feb. 21, 2013

(65) Prior Publication Data

US 2014/0230611 A1 Aug. 21, 2014

(51) Int. Cl.

| | |
|---|---|
| ***B25B 13/06*** | (2006.01) |
| ***B25B 13/48*** | (2006.01) |
| ***B25B 13/46*** | (2006.01) |
| ***B25B 23/00*** | (2006.01) |

(52) U.S. Cl.

CPC ..... *B25B 13/06* (2013.01); *B25B 13/461* (2013.01); *B25B 13/481* (2013.01); *B25B 23/0028* (2013.01)

USPC ..... 81/124.7; 81/177.7

(58) Field of Classification Search

USPC ..... 81/124.7, 177.2, 177.6, 177.7, 177.8, 81/73

See application file for complete search history.

(56) References Cited

U.S. PATENT DOCUMENTS

| | | | | |
|---|---|---|---|---|
| 2,886,998 | A * | 5/1959 | Scott | 81/177.9 |
| 5,280,740 | A * | 1/1994 | Ernst | 81/177.7 |
| 5,797,300 | A * | 8/1998 | Fairbanks | 81/60 |
| 6,167,787 | B1 * | 1/2001 | Jarvis | 81/177.2 |
| 6,324,947 | B2 * | 12/2001 | Jarvis | 81/177.2 |
| 7,311,018 | B1 * | 12/2007 | Liou et al. | 81/60 |
| 7,444,908 | B2 * | 11/2008 | Lin | 81/438 |
| 7,905,163 | B1 * | 3/2011 | Chiang | 81/177.9 |
| 8,297,156 | B2 * | 10/2012 | Chiu | 81/177.8 |
| 8,757,034 | B2 * | 6/2014 | Skogerboe et al. | 81/119 |
| 2004/0060398 | A1 * | 4/2004 | Hsien | 81/177.7 |
| 2007/0051212 | A1 * | 3/2007 | Hsieh | 81/177.7 |

* cited by examiner

*Primary Examiner* — David B Thomas

(57) ABSTRACT

A wrench device includes a handle, a driving member and a driving sleeve, the handle having a fork portion defined at one end thereof, the fork portion being pivotally assembled with the driving member, the handle having a screwing portion defined at another end thereof, a screwing hole being opened at one end of the screwing portion, an opening of the screwing hole being opposite to the fork portion, the driving sleeve sleeving on an outer periphery of the screwing portion. Under this arrangement, a user applies a sleeving member to sleeve on the driving member so as to screw or unscrew a bolt; in addition, the user also can operate the screwing portion of the wrench device to screw or unscrew the bolt.

4 Claims, 6 Drawing Sheets

WRENCH DEVICE

BACKGROUND OF THE INVENTION

1. Field of the Invention

The present invention relates to a wrench device, and more particularly to a wrench device which can fit various spatial sizes of the working place.

2. Description of Related Art

Thanks to the well developed industrial arts, different kinds of hand tools with various functions are appeared in the markets. However, when each step of a work has a specific hand tool, it also means that the user needs to prepare a great number of hand tools for dealing with all the steps involving in the work. Therefore, it is very inconvenient for the user to finish the work. Moreover, when the spatial size of the working place is not proper enough for operating the hand tool, the user cannot finish the work eventually.

A conventional wrench device with a pivoting tool head comprises a locking member disposed between a handle and a tool head and is controlled by a controller to come close to or keep away from the tool head. The controller is provided with a pushing portion and a retracting portion, and an elastic positioning assembly serves to fix the controller, such that the controller can be fixed after being pulled by the user. In addition, the pushing portion or the retracting portion of the controller is aligned with the locking member, so that the locking member will contact the tool head so as to fix the tool head, or will not contact the tool head so as to make the tool head swing, thus providing a quick positioning structure and improving the stability of the products, such that the user operates the conventional wrench device with a pivoting tool head in the working place with a small spatial size.

However, the conventional wrench device with a pivoting tool head has some disadvantages described as following.

Firstly, although the conventional wrench device with a pivoting tool head can be used in the working place with a small spatial size, the conventional wrench device with a pivoting tool head cannot be used in working places with spatial sizes which are smaller than the tool head.

Secondly, when each of the components of said conventional wrench is damaged, the user hardly replaces the broken components with a new one because of the complicatedness.

Thirdly, under long term use, some tiny components would detach from said conventional wrench and be lost eventually so that said conventional wrench operates improperly.

The present invention has arisen to mitigate and/or obviate the disadvantages of the conventional.

SUMMARY OF THE INVENTION

The main objective of the present invention is to provide a wrench device.

To achieve the objective, a wrench device comprises a handle, a driving member and a driving sleeve, the handle having a fork portion defined at one end thereof, the fork portion being pivotally assembled with the driving member, the handle having a screwing portion defined at another end thereof, a screwing hole being opened at one end of the screwing portion, an opening of the screwing hole being opposite to the fork portion, the driving sleeve sleeving on an outer periphery of the screwing portion. Wherein, the fork portion of the handle further has two pivoting portions defined thereon; a distance is defined between the two pivoting portions; the driving member has an extruding portion extruded at one end thereof; the extruding portion corresponds to the two pivoting portions; the extruding portion is assembled with the fork portion so as to be positioned between the two pivoting portions; a pivoting shaft passes through one of the two pivoting portions, the extruding portion of the driving member and another one of the two pivoting portions in order; the screwing portion further has a slot annularly recessed around the outer periphery thereof; the driving sleeve has a groove annularly opened around an inner periphery thereof; the groove corresponds to the slot; a buckling ring is engaged with the slot and the groove, so that the driving sleeve is assembled to the screwing portion via the buckling ring; a handling segment is defined between the fork portion of the handle and the screwing portion.

Further benefits and advantages of the present invention will become apparent after a careful reading of the detailed description with appropriate reference to the accompanying drawings.

DETAILED DESCRIPTION OF THE INVENTION

Figure 1:
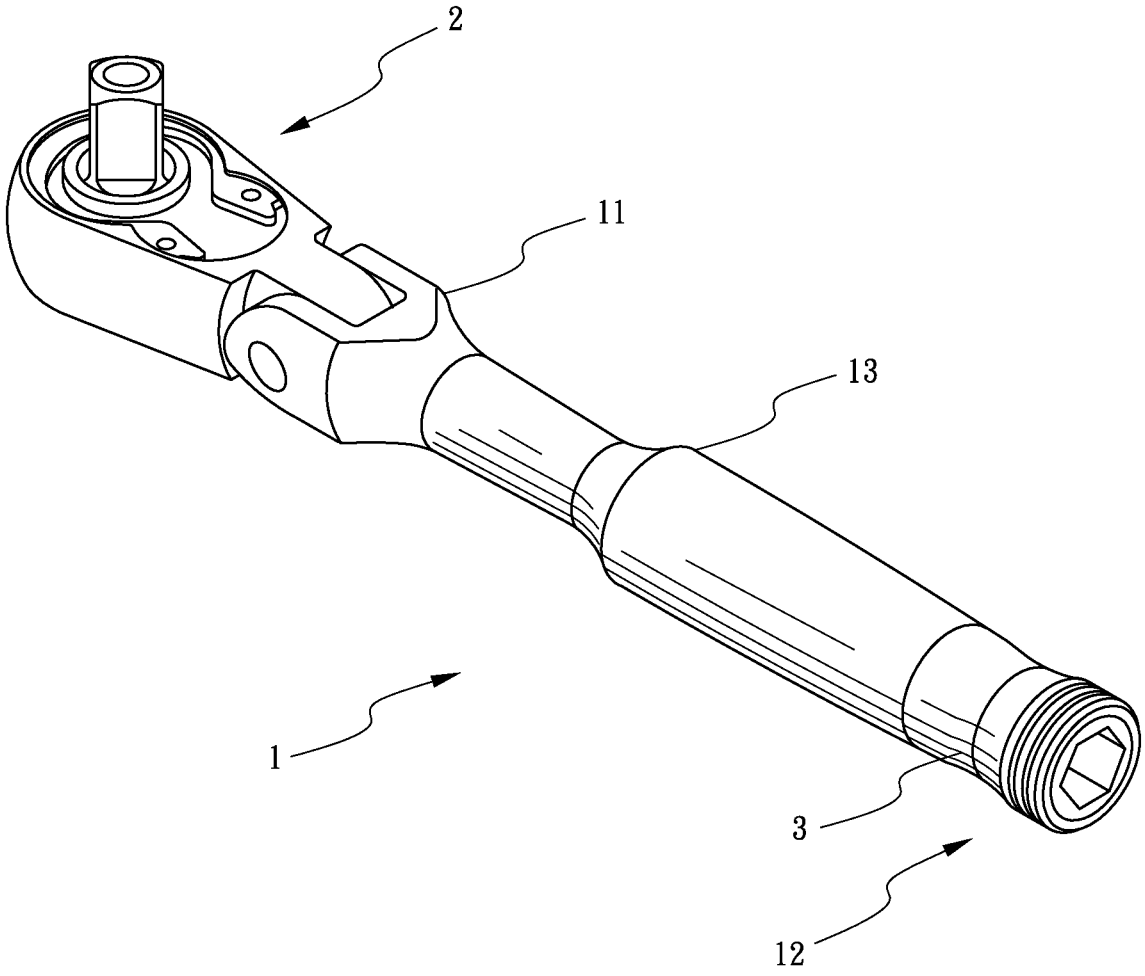
FIG. 1 is a perspective view of a wrench device of the present invention.

Referring to FIGS. 1-5, a wrench device comprises a handle 1, a driving member 2 and a driving sleeve 3.

The handle 1 has a fork portion 11 defined at one end thereof. The fork portion 11 is pivotally assembled with the driving member 2. The handle 1 has a screwing portion 12 defined at another end thereof. A screwing hole 121 is opened at one end of the screwing portion 12. An opening of the screwing hole 121 is opposite to the fork portion 11. The driving sleeve 3 sleeves on an outer periphery of the screwing portion 12. Under this arrangement, a user applies a sleeving member (not numbered, shown in FIG. 8) to sleeve on the driving member 2 so as to screw or unscrew a bolt; in addition, the user also can operate the screwing portion 12 of the present invention to screw or unscrew the bolt.

Figure 6:
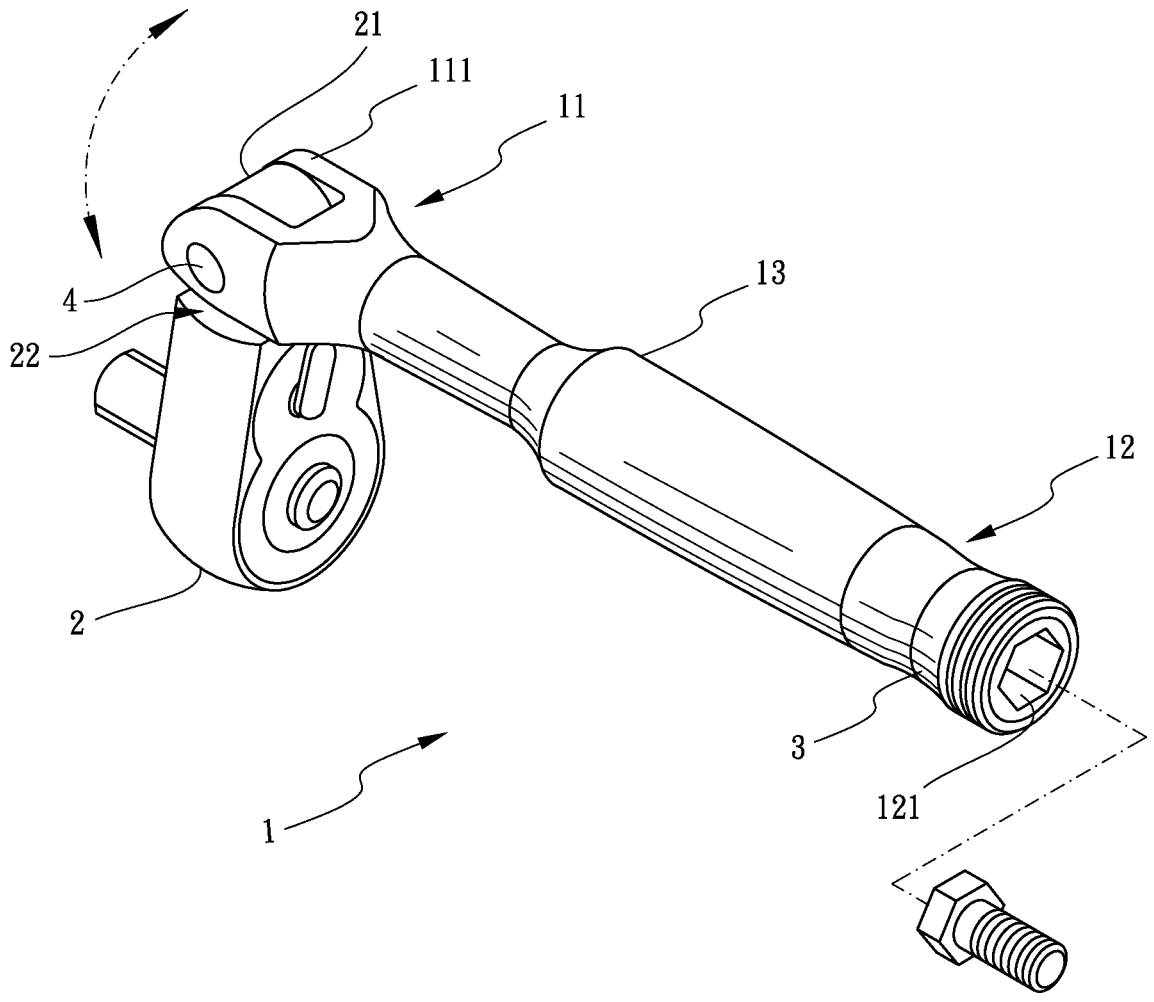
FIG. 6 is a schematic view of the present invention for showing a driving member pivots relative to a handle.

As shown in FIG. 6, the user optionally selects the driving member 2 or the screwing portion 12 for working according to the spatial size of the working place.

The details about the operation of the driving member 2 and the screwing portion 12 are described as following two paragraphs.

Figure 2:
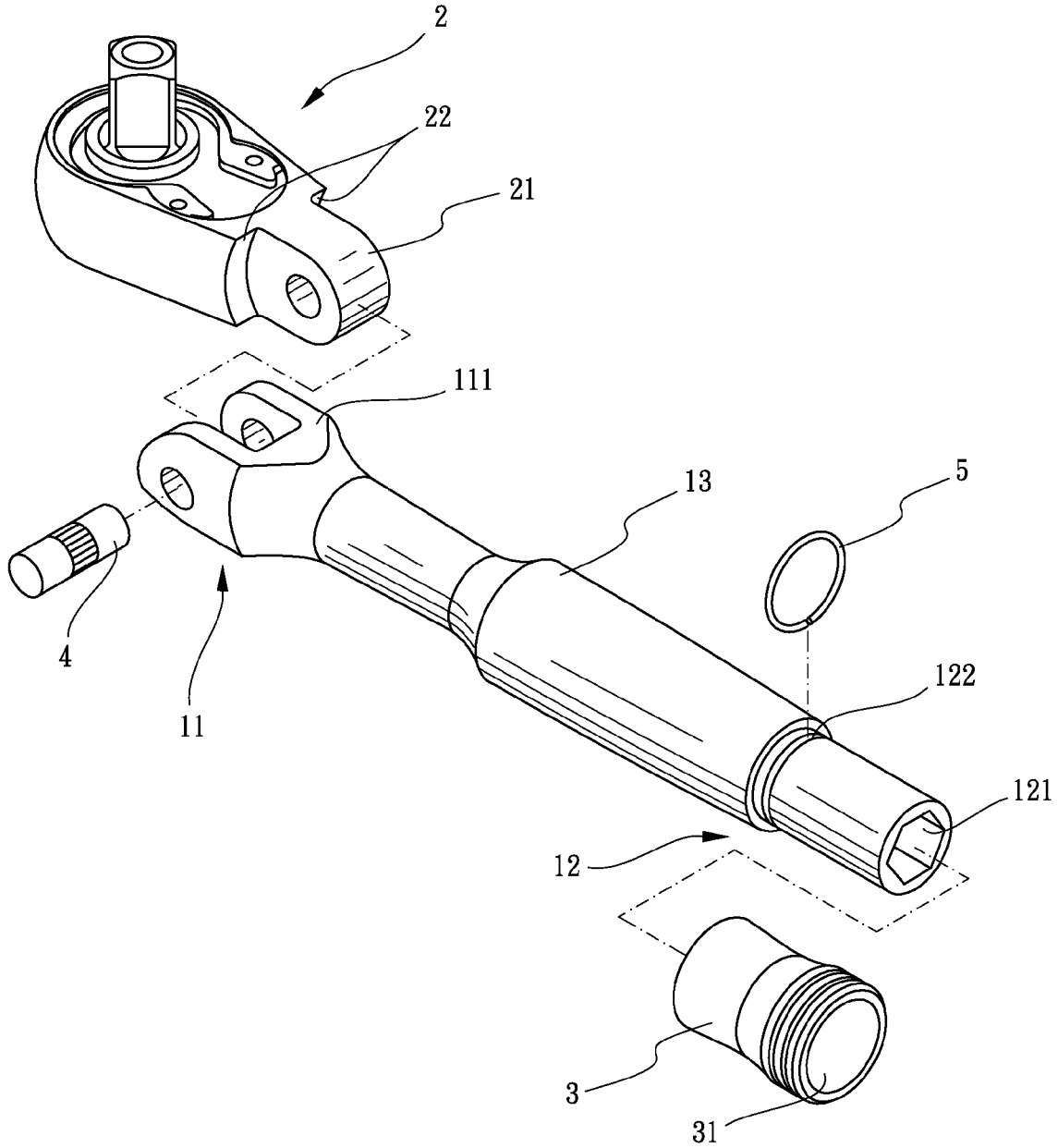
FIG. 2 is an exploded view of the wrench device.
Figure 3:
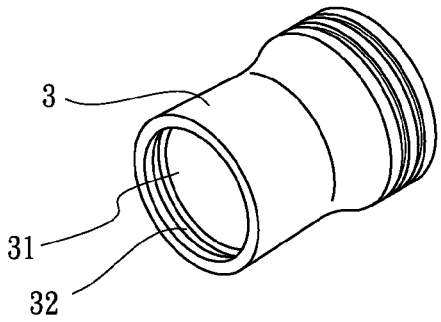
FIG. 3 is an enlarged view of a driving sleeve of the wrench device.
Figure 4:
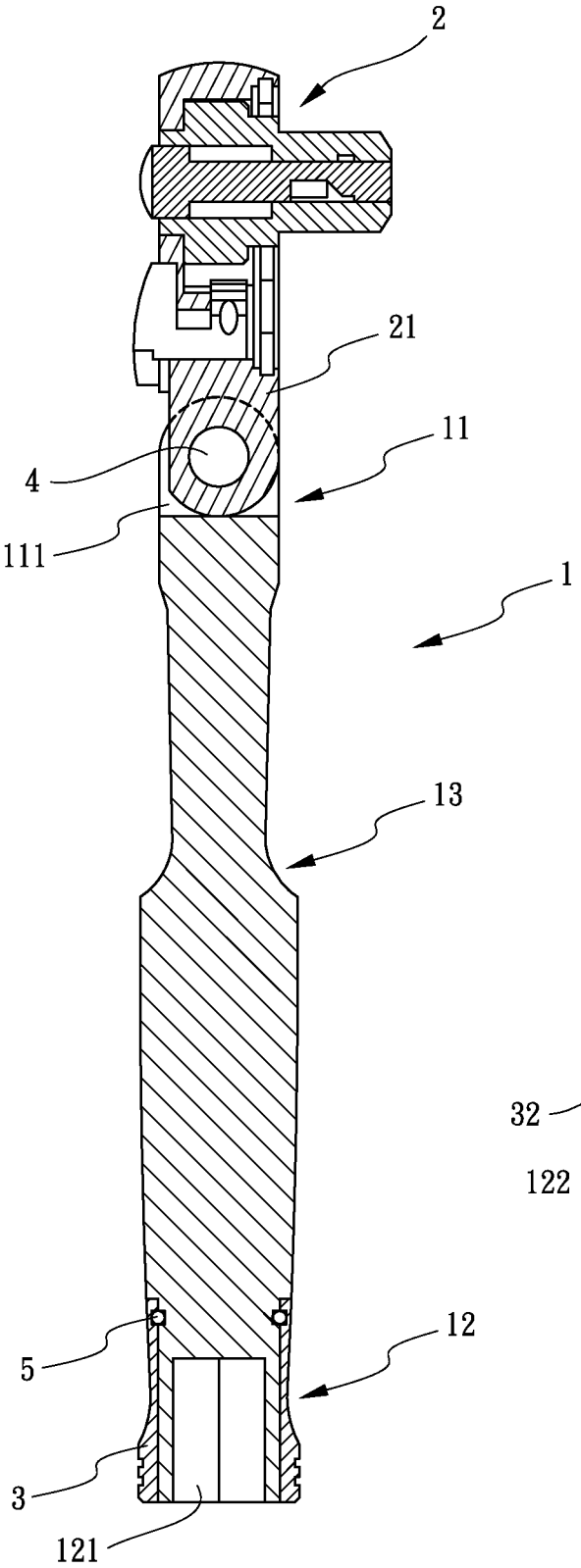
FIG. 4 is a cross-sectional view of the wrench device.
Figure 5:
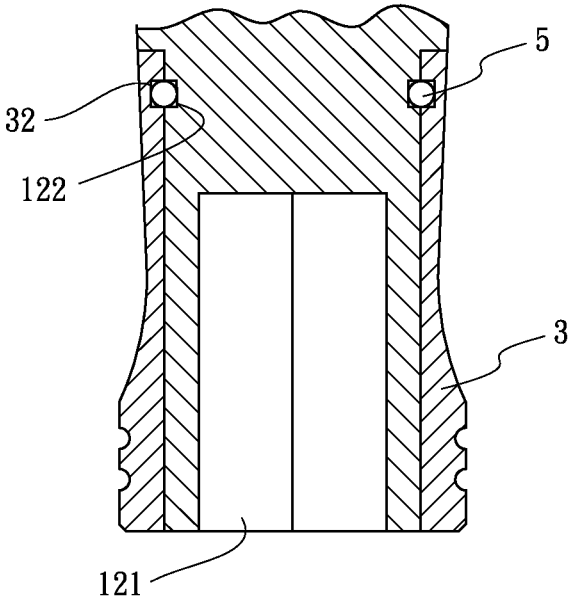
FIG. 5 is an enlarged and cross-sectional view for showing a screwing portion of the wrench device.
Figure 7:
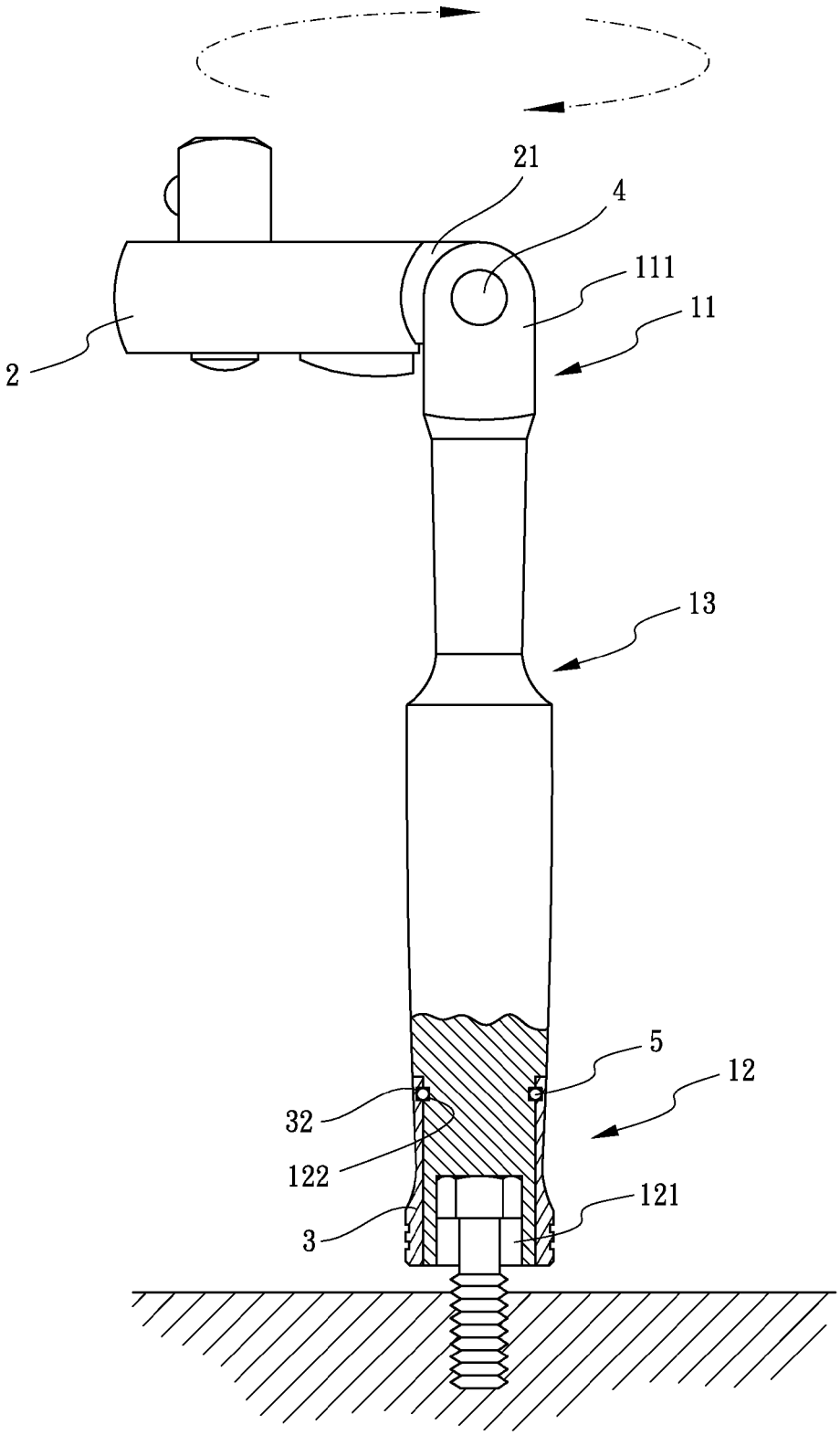
FIG. 7 is a schematic view for showing the screwing portion of the present invention sleeves on a bolt.

Referring to FIG. 2 and FIG. 7, when the spatial size of the working place is so small that the user cannot screw (or unscrew) the bolt via the driving member 2, the user can alternately screw (or unscrew) the bolt via the screwing portion 12, wherein the user covers an upper portion of the bolt with the screwing hole 121 of the screwing portion 12 and pivotally rotates the driving member 2 relative to the handle 1, so that the user holds the driving member 2 and the driving sleeve 3 to rotate the handle 1 so as to screw (or unscrew) the bolt. Under this arrangement, the user operates the present invention conveniently, quickly and easily.

Figure 8:
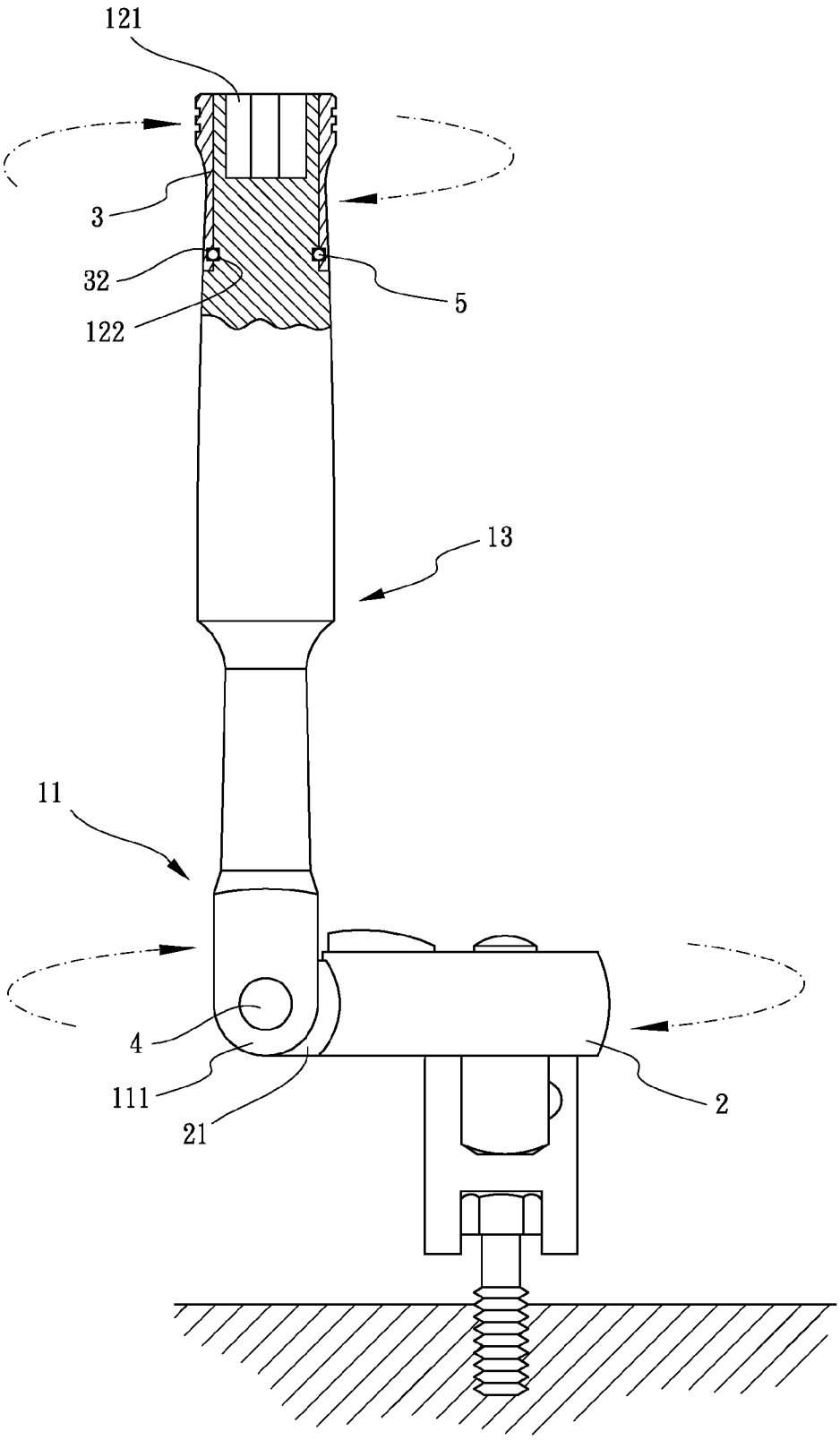
FIG. 8 is a schematic view for showing a sleeving member sleeves on the driving member of the present invention so as to screw the bolt.

Referring to FIG. 2 and FIG. 8, when the spatial size of the working place is large enough for the operation of the driving member 2, the user can screw (or unscrew) the bolt via not only the screwing portion 12 but also the driving member 2. The operation of the driving member 2 is briefed as below. The driving member 2 is pivoted relative to the handle 1 firstly; then, the sleeving member sleeves on the driving member 2 so as to engage with the bolt for screwing the bolt. (The technological details about the driving member 2 and the sleeving member are known so as to be omitted.).

The present invention has following characteristics.

The fork portion 11 of the handle 1 further has two pivoting portions 111 defined thereon. A distance is defined between the two pivoting portions 111. In a preferred embodiment, each pivoting portion 111 forms as semicircular arc shaped. The driving member 2 has an extruding portion 21 extruded at one end thereof. The extruding portion 21 corresponds to the two pivoting portions 111. Two lateral sides of the extruding portion 21 and the bottom face of the driving member 2 form two assembling spaces 22 adjacent to two sides of the extruding portion 21 respectively. The extruding portion 21 is assembled with the fork portion 11 so as to be positioned between the two pivoting portions 111, so that the two lateral sides of the extruding portion 21 closely attach to two corresponding inner sides of the two pivoting portions 111 respectively. The two pivoting portions 111 are disposed in the two assembling spaces 22 correspondingly with a top of each pivoting portion 111 being closely attaching to the bottom face of the driving member 2. In one preferred embodiment, an outline of the bottom face of the driving member 2 corresponds to the tops of the two pivoting portions 111 and is formed as semicircular concaved. A pivoting shaft 4 passes through one of the two pivoting portions 111, the extruding portion 21 of the driving member 2 and another one of the two pivoting portions in order, so that the driving member 2 pivots relative to the handle 1. The screwing portion 12 further has a slot 122 annularly recessed around the outer periphery thereof. The driving sleeve 3 has a void 31 axially opened therethrough. The screwing portion 12 is inserted into the void 31. The driving sleeve 3 has a groove 32 annularly opened around an inner periphery thereof. The groove corresponds to the slot 122. A buckling ring 5 is engaged with the slot 122 and the groove 32, so that the driving sleeve 3 is assembled to the screwing portion 12 via the buckling ring 5.

Further, as shown in FIG. 1, a handling segment 13 is defined between the fork portion 11 of the handle 1 and the screwing portion 12, so that the user holds the handling segment 13 to operate the present invention.

Although the invention has been explained in relation to its preferred embodiment, it is to be understood that many other possible modifications and variations can be made without departing from the spirit and scope of the invention as hereinafter claimed.

What is claimed is:

1. A wrench device comprising a handle, a driving member and a driving sleeve; and the handle having a fork portion defined at one end thereof, the fork portion being pivotally assembled with the driving member, the handle having a screwing portion defined at another end thereof, a screwing hole being opened at one end of the screwing portion, an opening of the screwing hole being opposite to the fork portion, the driving sleeve sleeving on an outer periphery of the screwing portion.

2. The wrench device as claimed in claim 1, wherein the fork portion of the handle further has two pivoting portions defined thereon; a distance is defined between the two pivoting portions; the driving member has an extruding portion extruded at one end thereof; the extruding portion corresponds to the two pivoting portions; the extruding portion is assembled with the fork portion so as to be positioned between the two pivoting portions; a pivoting shaft passes through one of the two pivoting portions, the extruding portion of the driving member and another one of the two pivoting portions in order.

3. The wrench device as claimed in claim 1, wherein the screwing portion further has a slot annularly recessed around the outer periphery thereof; the driving sleeve has a groove annularly opened around an inner periphery thereof; the groove corresponds to the slot; a buckling ring is engaged with the slot and the groove, so that the driving sleeve is assembled to the screwing portion via the buckling ring.

4. The wrench device as claimed in claim 1, wherein a handling segment is defined between the fork portion of the handle and the screwing portion.

* * * * *